United States Patent [19]

Christian

[11] 4,284,207

[45] Aug. 18, 1981

[54] DROP SHELF MECHANISM

[76] Inventor: Donald K. Christian, 119 Woodbine Ter., Spartanburg, S.C. 29301

[21] Appl. No.: 66,480

[22] Filed: Aug. 13, 1979

[51] Int. Cl.[3] ..... G07F 11/06

[52] U.S. Cl. ..... 221/90

[58] Field of Search ..... 221/90, 155, 213, 230, 221/231, 232

[56] References Cited

U.S. PATENT DOCUMENTS 3,446,396 5/1969 Gasiel et al. ..... 221/90

3,946,846 3/1976 Pepiciello et al. ..... 221/90 X

*Primary Examiner*—Stanley H. Tollberg

[57] ABSTRACT

A novel system for supporting, releasing and resetting the shelves of a drop shelf vending machine wherein a pawl with a double sided actuating ramp is retracted by an extended roller chain link pin on the upward or vend cycle, the back side of actuating ramp being of such configuration as to act as a passive guide for the extended pin on the downward or reset cycle and, whereby a lever controlled linkage raises a multiplicity of shelves in a single operation.

6 Claims, 4 Drawing Figures

DROP SHELF MECHANISM

BACKGROUND OF THE INVENTION

Numerous techniques have been heretofore been devised for vending a wide variety of products by means of sequentially dropping a series of shelves causing the contents thereof to be dropped and guided or conveyed out to the customer. The resultant machines have generally been quite satisfactory from an operational stand point but frequently have not been economically feasable due to the length of time required for service and loading. This is generally recognized by those skilled in the art. U.S. Pat. No. 3,946,846 Pepiciello recognizes this need and teaches a means for minimizing the service cycle. To wit: the use of a "pivotably mounted master dog rotatable between an actuation position and a reset position" to facilitate the resetting of the shelf drop mechanism without disturbing those shelves which are still loaded and ready to vend. While of substantial value in its time it did make no provision for the rapid resetting of the shelves themselves. With many machines this can be an even greater time consuming function than the resetting of the shelf drop mechanism.

The present invention is in part a significant symplification of the Pepiciello system in that it teaches the use of an extended roller chain link pin as an actuator for dropping the shelves and a shelf supporting pawl or dog of such configuration that it does not obstruct but rather guides said actuator during the resetting cycle. In addition it also teaches the use of a lever controlled linkage to reset the empty shelves without materially disturbing the loaded ones. This shelf resetting means does result in a substantial saving when the service person has a large number of machines to service in a short period of time such as in the newspaper industry or, in machines where the shelves are not easy to reach and reset on a one at a time basis.

The detailed description of the moving parts and their function in the above mentioned patent attests to the fact that the simplicity of the present invention's actuator and pawls was neither suggested nor anticipated. Neither the above mentioned nor U.S. Pat. No. 464,067 Foster, 1,256,071 Steiner, or 2,904,216 Poland suggest nor anticipate the present rapid shelf resetting means.

SUMMARY OF THE INVENTION

It is the object of the present invention to provide a novel and simplified means for resetting the shelf drop mechanism of a drop shelf vending machine. A further object of the present invention is to provide a time saving means for resetting the shelves of a drop shelf vending machine.

Generally speaking, the present invention relates to any vending machine wherein the merchandise for sale is supported on a pivotally mounted shelf, tray or rack, so oriented as to remove support from said merchandise upon proper activation causing same to move to a position of accessability from outside the vending machine's enclosure.

More specifically, the present invention teaches the use of a shelf support means which can be removed from a position of support to a position of release by the generally upward motion of an actuator traversing a generally vertical path, said support means being so constructed that it acts as a passive non-obstructing guide during the generally downward motion of said actuator during the resetting cycle. Said actuator is conveyed over its generally vertical path by a cable operatively linked to a manually releasable ratchet mechanism and a reciprocating coin acceptor mechanism as in U.S. Pat. No. 3,946,846 Pepiciello or by a chain operatively linked to shafts and, with or without ratchets, to a rotatable knob coin mechanism as in U.S. Pat. No. 2,361,977 Stair or, in any of the other electrical or mechanical mechanisms known to those skilled in the art.

DESCRIPTION OF THE PREFERRED EMBODIMENTS

Figure 1:
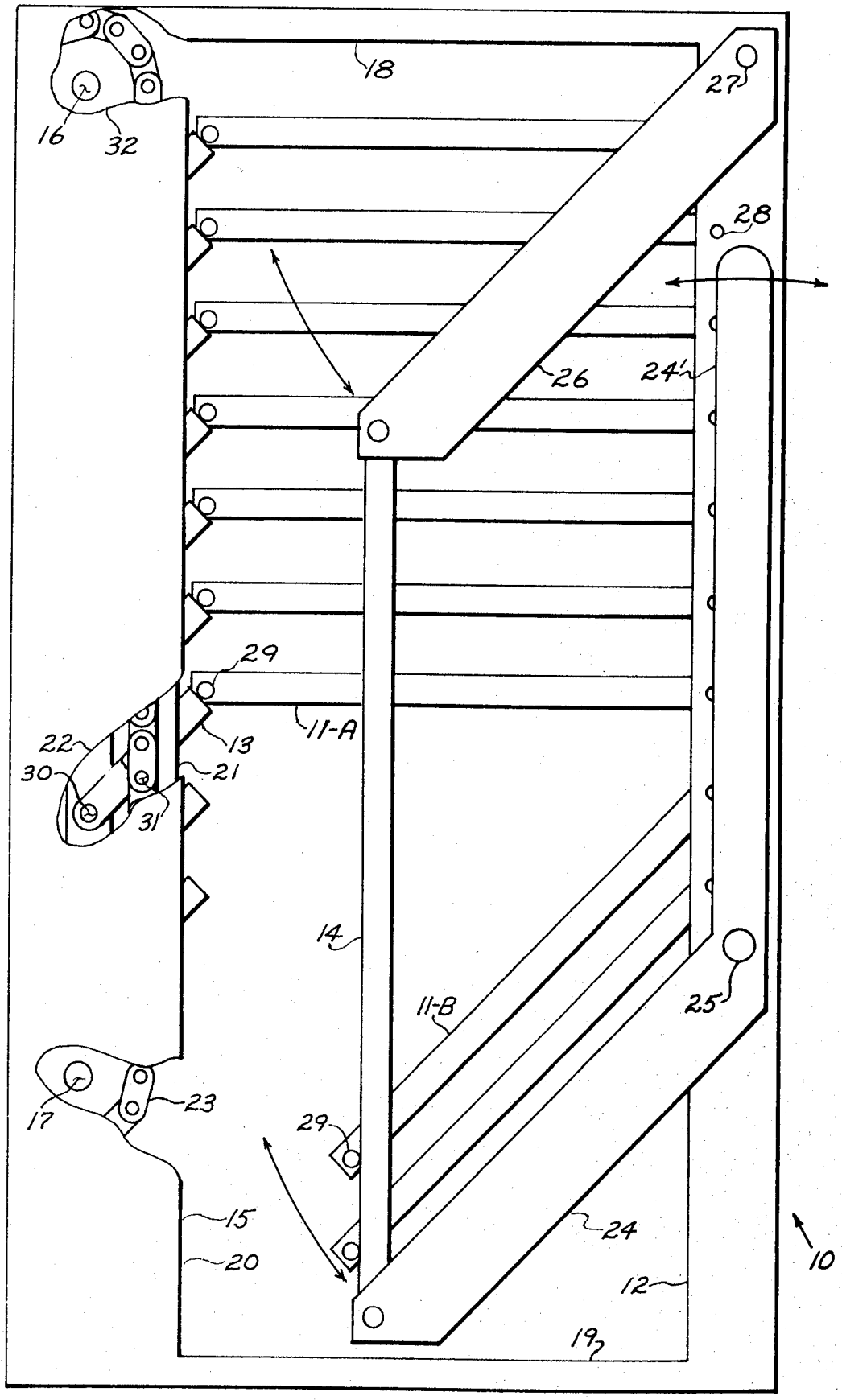
FIG. 1 is the end view of a drop shelf magazine.

Making reference to the Figures, a specific embodiment of the present invention will now be described in detail. Referring to FIG. 1, a drop shelf magazine generally indicated as 10 is shown. Magazine is comprised of horizontally supported shelves 11-A, dropped shelves 11-B pivotally mounted from vertical frame member 12 by means of pins 28 on one side and supported on the other side in the instance of 11-A by shelf pawl 13 and in the instance of 11-B by reset bar 14. Vertical frame member 15 is provided with appropriate bushings to receive drive shaft 16 and idler shafts 17, horizontal frame members 18 and 19 are provided to define unitary structure 20. Chain guide 21 and pawl mounting block 22 are positioned within said structure to receive shelf pawls 13 and chain 23 respectively. Lower shelf reset arm 24 is pivotally mounted to vertical frame member 12 by means of shaft 25. Upper shelf reset arm 26 is pivotally mounted to vertical member 12 by means of shaft 27.

Figure 3:
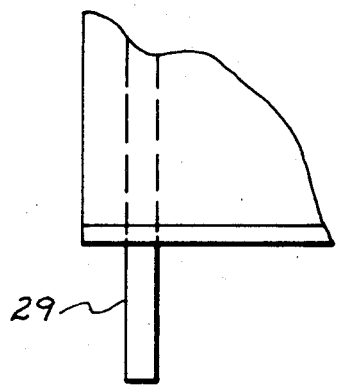
FIG. 3 is a fragmentary view showing the corner of a shelf.

In reference to FIG. 3, shelves 11-A and 11-B are provided with shaft 29 for engagement with a support and/or activation means. As outward force is applied to handle 24' reset bar 14 actuates shelves 11-B in an upward pivotal motion as indicated by arrows. As upward motion continues shaft 29 engages shelf pawl 13 causing it to rotate upwardly about shelf pawl pin 30 until shaft 29 has risen above the rotational path of pawl 13. As the obstructive presence of shaft 29 is removed said pawl falls to its original position. As the force being applied to handle 24' is reversed shaft 29 comes to rest on shelf pawl 13 thus shelves 11-B assume the position of shelves 11-A. It should be noted that during the above described resetting cycle the position of the previously horizontal shelves 11-A is not functionally changed.

Figure 2:
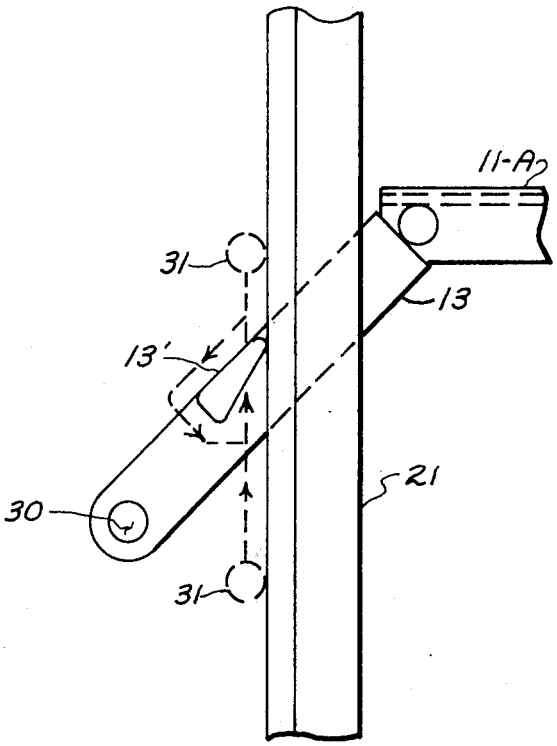
FIG. 2 is the detail of the shelf support mechanism.
Figure 4:
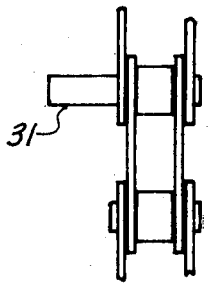
FIG. 4 is a fragmentary view of the chain.

Operation of the shelf support mechanism proceeds as follows. Upon actuation of a coin mechanism, shaft 16, sprocket 32, chain 23 and actuator 31 are indexed causing a generally upward motion of actuator 31 for a distance generally equal to the vertical spacing of shelves 11-A. This indexing may be the product of any of the following coin mechanism linkages: a reciprocating, ratcheting motion, a knob rotating motion or an electrical motivation. In reference to FIGS. 2 and 4, the path of actuating pin 31 is generally upward, as said actuating pin wedges between pawl lip 13' and chain guide 21, pawl 13 rotating on pawl pin 30 moves from its position of support under shelf 11-A causing same to rotate downwardly about pin 28 dropping its contents, if any, thru appropriate chutes and/or guides to a point of customer accessability. The process is repeated with the next higher shelf support system with each subsequent insertion of proper coinage. In each instance, the empty pawl 13 falls back in place as actuator pin 31 rises above pawl lip 13'. During the resetting reloading cycle drive shaft 16 may be manually reversed by means of appropriate mechanisms and actuating pin 31 follows a unobstructed downward path generally indicated by the downward arrows until it reaches a predetermined position below the bottommost shelf pawl. Handle 24' is then cycled as described above and magazine is thus readied for reloading.

Having described the present invention in detail, it is obvious that one skilled in the art will be able to make modifications and variations thereto without departing from the scope of the invention. Accordingly, the scope of the present invention should be determined by the claims appended hereto.

What is claimed is:

1. A novel means for supporting, releasing and resetting the shelves of a drop shelf vending machine comprising pivotally mounted pawls supporting the shelves, each pawl having a lip and a guide surface, a guide member supporting the lips in leaning contact, and moving means adjacent the guide and lip carrying an actuator pin wherein said actuator pin traversing a generally vertical predetermined path on its upward cycle wedges itself between said guide member and a pawl lip causing said pawl to rotate about its pivotal axis thus being removed from its position of support under a pivotally mounted shelf and which on its downward cycle is guided over a path created at least in part by a surface of said pawl other than that engaged on its upward path.

2. A means as described in claim 1 where a guide other than a pawl surface is provided for the downward reset cycle.

3. A means as described in claim 1 where the shelves are replaced with other forms of pivotally mounted merchandise supports.

4. A shelf pawl or support as described in claim 1 which serves as a guide for the resetting of a non-rotating shelf support release means.

5. A means as described in claim 1 where the shelves are replaced with trays, racks, hoppers or other forms of pivotally mounted merchandise supports.

6. A means as described in claim 1 where the shelves are released by tilting the support means rather than by a wedging action.

* * * * *